US005188711A

United States Patent [19]

Feddrix

[11] Patent Number: 5,188,711

[45] Date of Patent: Feb. 23, 1993

[54] ELECTROLYTIC PROCESS FOR MAKING ALLOYS OF RARE EARTH AND OTHER METALS

[75] Inventor: Frank H. Feddrix, Westlake, Ohio

[73] Assignee: Eveready Battery Company, Inc., St. Louis, Mo.

[21] Appl. No.: 686,894

[22] Filed: Apr. 17, 1991

[51] Int. Cl.[5] ..... C25C 3/36

[52] U.S. Cl. ..... 204/71; 204/290 R; 204/292; 204/294

[58] Field of Search ..... 204/64 R, 71, 292, 294, 204/290 R

[56] References Cited

U.S. PATENT DOCUMENTS

| | | | |
|---|---|---|---|
| 3,383,294 | 5/1968 | Wood | 204/71 X |
| 3,524,800 | 8/1970 | Morrice et al. | 204/71 |
| 3,729,397 | 4/1973 | Goldsmith et al. | 204/71 X |
| 3,909,247 | 9/1975 | Paris et al. | 75/84.1 R |
| 3,910,831 | 10/1975 | Helart | 204/278 |
| 4,121,924 | 10/1978 | de Barbadillo, II | 75/129 |
| 4,578,242 | 3/1986 | Sharma | 420/590 |
| 4,612,047 | 9/1986 | Schmidt et al. | 420/83 |
| 4,680,055 | 7/1987 | Sharma | 75/84.5 |
| 4,684,448 | 8/1987 | Itoh et al. | 204/71 |
| 4,737,248 | 4/1988 | Nakamura et al. | 204/71 |
| 4,966,661 | 10/1990 | Tamamura | 204/71 X |

FOREIGN PATENT DOCUMENTS

| | | |
|---|---|---|
| 63-266086 | 11/1988 | Japan . |
| 1-065285 | 3/1989 | Japan . |
| 1-079391 | 3/1989 | Japan . |
| 2-004994 | 1/1990 | Japan . |
| 2-080588 | 3/1990 | Japan . |
| 2-101186 | 4/1990 | Japan . |

OTHER PUBLICATIONS

"Methods for the Production of Rare Earth-3d Metal Alloys with Particular Emphasis on the Cobalt Alloys"; C. Herget and H. G. Domazer.

"Study on the Preparation of Lanthanum-Nickel Alloys by Molten Salt Electrolysis" *Acta Scientiarum Naturalium Universitatis Sunyatseni,* vol. 29, No. 2, pp. 129-132.

"Preparation of Rare Earth Metals and Their Alloys by Fused Salt Electrolysis in China," *New Frontier Rare Earth Science Applications,* vol. 2, pp. 1117-1126.

*Primary Examiner*—Donald R. Valentine

*Attorney, Agent, or Firm*—Robert W. Welsh

[57] ABSTRACT

Alloys of rare earth metals and other metals are made in an electrolytic process.

14 Claims, No Drawings

ELECTROLYTIC PROCESS FOR MAKING ALLOYS OF RARE EARTH AND OTHER METALS

FIELD OF THE INVENTION

This invention relates to the manufacture of alloys of rare earth metals and other metals.

BACKGROUND OF THE INVENTION

Alloys of rare earth metals and other metals are useful in a variety of applications. For example, neodymium and iron alloys are used as industrial magnets. Lanthanum and nickel alloys are useful as hydrogen absorbing materials.

The alloys can be made in a variety of ways. One of these methods is a metallothermic process. An example of this process is a calciothermic process in which a rare earth metal fluoride is reduced with calcium metal. Alternatively, a rare earth metal oxide is reduced with calcium hydride or calcium metal to yield the rare earth metal and calcium oxide.

In another method, the metals are simply melted together, for example in a vacuum induction furnace. This method requires a high amount of energy to produce the melt temperatures.

These processes are labor and energy intensive. Therefore there remains the need for new processes for making rare earth and other metal alloys.

SUMMARY OF THE INVENTION

This invention is a process for making alloys of rare earth metals and other metals. The process comprises contacting a rare earth metal salt with an alloying metal compound under conditions sufficient to form a liquid mixture. An anode and a cathode are placed in contact with the mixture and an electrical potential is placed between the anode and cathode so that an alloy of the rare earth metal and alloying metal is formed at one of the electrodes.

The addition of the alloying metal to the rare earth metal compound in the electrolytic bath improves the processability of the alloy. When a eutectic is formed between the rare earth metal and alloying metal the electrolytic cell can be run at a lower temperature, and thus the corrosion of the cell is reduced and a purer product can be obtained.

DETAILED DESCRIPTION OF THE INVENTION

The rare earth metal component useful in the process of this invention is an individual metal or a mixture of different rare earth metals in the form mischmetal. The component is in the form of a salt of a rare earth metal. Examples of preferred salts include rare earth metal halides and oxides. The preferred halides are the chlorides and fluorides. Examples of highly preferred salts are lanthanum-rich rare earth chlorides and relatively pure $LaCl_3$.

The alloying metal used with the rare earth metal will be selected by the type of alloy desired. The alloying metal is selected based on its solubility in the electrolyte and molten rare earth bath, its melting point and its vapor pressure. Preferred alloying metals include the transition metals, such as nickel, cobalt, manganese and iron, and other metals such as aluminum. The type of alloy prepared will vary according to its intended use. For example, for neodymium, iron is a preferred transition metal for the manufacture of magnets. For lanthanum, nickel is a preferred alloying metal for the manufacture of hydrogen storage materials, and the use of iron is discouraged. Preferably the alloying metal is employed as the pure metal The rare earth metal and alloying metal are contacted in the presence of the electrolyte of the electrolytic cell. The electrolyte forms a bath for the cell and is comprised of molten components that will facilitate the transfer of the metals through the bath and the formation of the alloy at the desired electrode. The electrolyte is generally comprised of salts that are compatible with the rare earth metal salts. Examples include barium fluoride, lithium fluoride, sodium chloride, calcium chloride, potassium chloride, and lithium chloride. These can be used individually or as a mixture.

Preferably, the rare earth metal and alloying metal form a eutectic in the electrolytic bath. For example, lanthanum and mischmetal form a eutectic with nickel. By forming the eutectic, the electrolytic process can be run at lower temperatures, and thus corrosion of the cell parts can be reduced. Typically, the temperature of the process can range from about 500° C. to about 900° C., with the lower temperatures being preferred. The LaNi eutectic melts at about 550° C.

Two electrodes, a cathode and an anode, are placed into the electrolytic bath. An electrical potential is placed over the electrodes so that the rare earth and transition metal alloy forms at the cathode. After forming at the cathode, the molten alloy drops off and is collected as a separate phase from the electrolyte melt so it can be tapped. Gas usually forms at the anode.

The electrolytic cell amperage can range from about 12,000 amps to about 50,000 amps depending on cell design. Typically, the potential placed over the electrodes is sufficient to run the reaction, and will vary according to the components of the cell. The potential typically ranges from about 6 volts to about 15 volts. Between 8 to 10 volts is sufficient to reduce the rare earth salt to the rare earth metal. Higher voltages can superheat the mixture to improve its fluidity. This can assist in keeping the rare earth in solution and away from the slag. The formation of a rare earth metal and other metal alloy improves the fluidity of the rare earth metal mixture, thus higher voltages may not be required. To enhance the purity of the alloy, it is desirable to make or clad the electrode on which the alloy will be formed with the alloying metal. The alloy is then recovered from the bath.

The process can be run continuously over a time sufficient to produce the desired alloy. The rare earth metal salt and the alloying metal can be added continuously to the bath throughout process.

The alloys produced in the electrolytic process of this invention can be used to make hydrogen storage alloys, such as the LaNi5 type alloys. The hydrogen storage alloys can be made by adding additional nickel to the electrolytically prepared alloys in a vacuum induction method. Alternatively, additional alloying metal or rare earth metal can be added to the molten electrolytically prepared alloy as it is tapped from the cell. Preferably, the alloying metal will dissolve in this molten alloy, as is the case when nickel is added. This method takes advantage of the molten state of the alloy to thus avoid the necessity of using additional energy to melt the additional components. The recovered alloy can then be cast into molds to form ingots which are then crushed to produce a material useful in the manufacture of hydrogen storage electrodes.

What is claimed is:

1. A process for making alloys of rare earth metal and other metals comprising contacting a lanthanum salt with nickel under conditions sufficient to form a liquid mixture, placing an anode and a cathode in contact with the mixture and placing an electrical potential between the anode and cathode so that an alloy of lanthanum and nickel forms at one of the electrodes.

2. The process of claim 1, wherein the lanthanum salt is lanthanum chloride and the nickel is nickel pellets.

3. The process of claim 2, wherein the anode is made from carbon and the cathode is iron that is clad with nickel.

4. The process of claim 3 comprising the additional step of recovering the alloy from the cell.

5. The process of claim 4, wherein additional metal or rare earth metal are added to the molten recovered alloy.

6. A process for making alloys of rare earth metal and other metals comprising contacting a rare earth metal salt with a metal under conditions sufficient to form a eutectic liquid mixture; placing an anode and a cathode in contact with the mixture; and, placing an electrical potential between the anode and cathode so that an alloy of the rare earth metal and other metal forms at one of the electrodes.

7. The process of claim 6, wherein the anode is made from carbon and the cathode is made from iron.

8. The process of claim 6, comprising the additional step of recovering the alloy from the cell.

9. A process for making alloys of rare earth metal and other metals comprising contacting neodymium chloride with iron pellets under conditions sufficient to form a liquid mixture; placing an anode and a cathode in contact with the mixture; and placing an electrical potential between the anode and cathode so that an alloy of neodymium and iron forms at one of the electrodes.

10. A process for making alloys of rare earth metal and other metals comprising contacting a neodymium salt with iron under conditions sufficient to form a mixture; placing an anode and a cathode in contact with the mixture; placing an electrical potential between the anode and cathode so that an alloy of neodymium and iron forms at one of the electrodes; recovering the alloy from the cell; and adding additional metal or rare earth metal to the molten recovered alloy.

11. A process for making alloys of rare earth metal and other metals comprising contacting a rare earth metal salt with a metal under conditions sufficient to form a eutectic liquid mixture; placing an anode and a cathode in contact with the mixture; placing an electrical potential between the anode and cathode so that an alloy of the rare earth metal and other metal forms at one of the electrodes; recovering the alloy from the cell; and adding additional metal or rare earth metal to the molten recovered alloy.

12. A process for making alloys of mischmetal and other metals comprising contacting a mischmetal salt with a metal under conditions sufficient to form a eutectic liquid mixture; placing an anode and a cathode in contact with the mixture; and, placing an electrical potential between the anode and cathode so that an alloy of the mischmetal and other metal forms at one of the electrodes.

13. The process of claim 12, wherein the other metal is nickel.

14. A process for making alloys of rare earth metal and other metals comprising contacting a rare earth metal salt with nickel under conditions sufficient to form a eutectic liquid mixture; placing an anode and a cathode in contact with the mixture; placing an electrical potential between the anode and cathode so that an alloy of rare earth metal and nickel forms at one of the electrodes; recovering the alloy from the cell; and adding another metal to the molten recovered alloy.

* * * * *